US007347257B2

(12) United States Patent
Van Way

(10) Patent No.: US 7,347,257 B2
(45) Date of Patent: Mar. 25, 2008

(54) APARATUS FOR SPOOLED TUBING OPERATIONS

(76) Inventor: John Van Way, P.O. Box 51828, Lafayette, LA (US) 70505

( * ) Notice: Subject to any disclaimer, the term of this patent is extended or adjusted under 35 U.S.C. 154(b) by 0 days.

(21) Appl. No.: 11/706,595

(22) Filed: Feb. 14, 2007

(65) Prior Publication Data

US 2007/0158063 A1 Jul. 12, 2007

Related U.S. Application Data

(63) Continuation of application No. 10/935,762, filed on Sep. 7, 2004, now abandoned.

(51) Int. Cl.
*E21B 19/22* (2006.01)

(52) U.S. Cl. ..... 166/77.2; 166/78.1

(58) Field of Classification Search ..... 166/77.2, 166/78.1

See application file for complete search history.

(56) References Cited

U.S. PATENT DOCUMENTS

| | | | | |
|---|---|---|---|---|
| 2,810,439 | A * | 10/1957 | McCullough et al. | 166/77.2 |
| 6,315,052 | B1 * | 11/2001 | Sola | 166/384 |
| 6,516,892 | B2 * | 2/2003 | Reilly | 166/384 |
| 2003/0106715 | A1 * | 6/2003 | Clemmons | 175/19 |

* cited by examiner

*Primary Examiner*—Jennifer H. Gay
*Assistant Examiner*—David Andrews
(74) *Attorney, Agent, or Firm*—Ted M. Anthony

(57) ABSTRACT

A spooled tubing unit is provided which permits simultaneous translation and rotation of continuous tubing to drill or conduct other downhole operations in a borehole in subterranean formations.

3 Claims, 4 Drawing Sheets

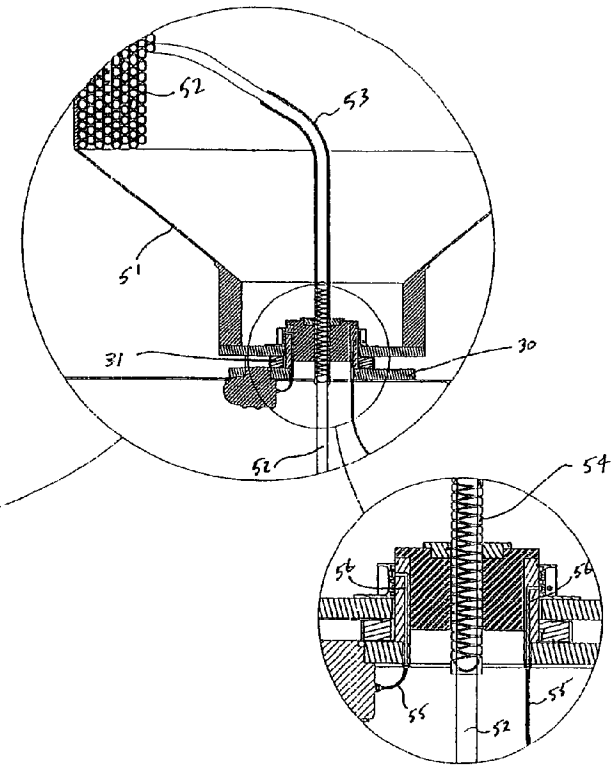
FIGURE 5
FIGURE 6
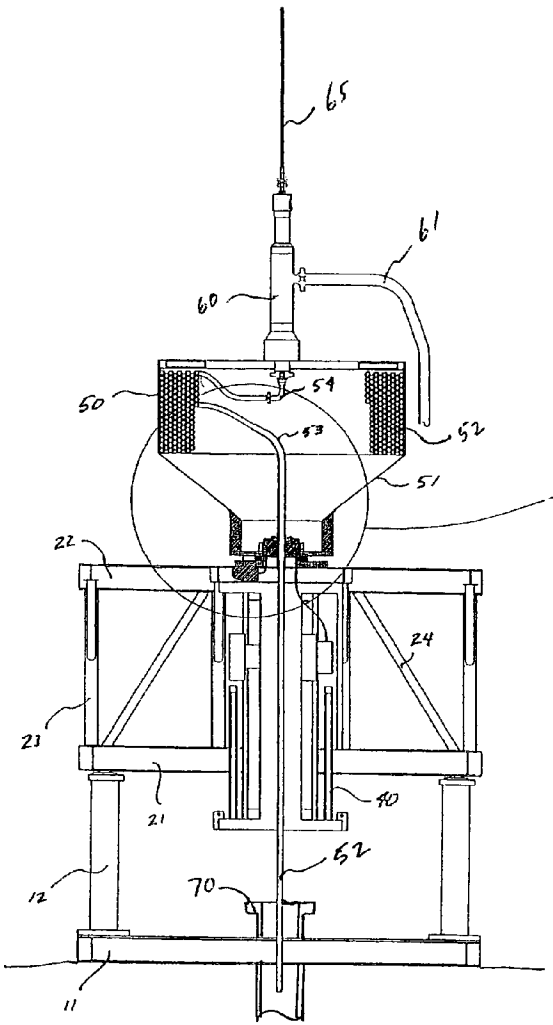
FIGURE 4

APARATUS FOR SPOOLED TUBING OPERATIONS

CROSS REFERENCES TO RELATED APPLICATIONS

This is continuation of application Ser. No. 10/935,762 filed Sep. 7, 2004, now abandoned.

BACKGROUND OF THE INVENTION

1. Field of the Invention

The present invention relates generally to spooled tubing operations. More particularly, the present invention relates to a system for simultaneously translating and rotating spooled tubing within a wellbore. More particularly still, the present invention involves a system which permits simultaneous translation and rotation of spooled tubing to drill or conduct other downhole operations in a borehole extending into subterranean formations.

2. Description of the Prior Art

Standard rotary drilling rigs are typically comprised of a supportive rig floor, a derrick extending vertically above said rig floor, and a traveling block which can be raised and lowered within said derrick. During drilling operations, this rig equipment is often used to insert and, in many cases remove, tubular goods from a wellbore situated under the derrick which extends downward into subterranean formations. Frequently, drill bits and/or other equipment are lowered into such wellbores and manipulated within said wellbores via tubular drill pipe in order to conduct downhole operations within such wellbores.

During downhole well operations, pipe (such as, for example, drill pipe, tubing, workstrings and the like) is typically inserted in a number of sections of roughly equal length. These pipe sections, commonly referred to as "joints," are typically installed one at a time, and screwed together or otherwise connected end-to-end to make a roughly continuous length of pipe. In order to start the process of inserting pipe in a well, a first joint of pipe is lowered into the wellbore at the rig floor, and suspended in place using a set of "lower slips." The lower slips hold the weight of the pipe and suspend such pipe in place in the well.

Once a first joint of pipe is inserted into a well, said joint is generally positioned so that its top is situated a few feet above the rig floor. A rig crew or pipe handling machine can then grab a second joint of pipe, lift said second joint of pipe vertically into the derrick, position said second joint above the first joint (which was previously run into and hanging within the well), and "stab" a male or "pin-end" thread at the bottom of said second joint into a female or "box-end" thread at the top of the first joint. The second joint is then rotated in order to mate the threaded connections of the first and second joints together.

Thereafter, a set of elevators connected to the traveling block in the rig's derrick, which is attached to the second (upper) joint of pipe, can be raised to take weight off of the lower slips. The lower slips are then removed, allowing the entire weight of the pipe string to be suspended from the elevators attached to the rig's traveling block. Both the first and second joints of pipe can then be inserted into the well by lowering the traveling block. After the second or upper joint of pipe is lowered a sufficient distance into the well, the lower slips are again inserted in place near the rig floor. The aforementioned process is repeated until the desired length of pipe (i.e., the desired number of pipe joints) is inserted into the wellbore. The same process is typically utilized for many different types and sizes of pipe, whether small diameter workstring or large diameter drill pipe or casing.

In order to remove a string of pipe from a wellbore, the aforementioned process is essentially performed in reverse. That is, the pipe string can be removed from the wellbore using the rig's traveling block until a desired length of pipe is positioned above the rig floor. The lower slips are set, and the pipe is then unscrewed at a point above said lower slips. Thereafter, the loose section of pipe hanging from the traveling block is moved out of the vicinity of the wellbore; said pipe is typically "racked back" vertically within the derrick, or transferred to a horizontal pipe rack located apart from the derrick. This process is repeated until the desired length of pipe has been removed from a wellbore.

In recent years, oil and gas operators have discovered an alternative to conventional rig operations employing a continuous length of flexible tubing rather than multiple sections of rigid pipe. This alternative, commonly referred to as "coiled tubing", utilizes a continuous length, up to 10,000 feet or more, of flexible tubing which is stored on a reel. Such conventional coiled tubing can be translated in and out of a wellbore in a virtually continuous manner without the need to continually connect and/or disconnect individual pipe sections as described above.

Conventional coiled tubing can be used to conduct numerous downhole operations. For example, coiled tubing can be concentrically inserted into an existing wellbore in order to clean out sand or other debris from such well. Further, conventional coiled tubing can be used to drill a borehole by attaching a hydraulic "mud motor" and drill bit to the distal end of the tubing, and then pumping pressurized drilling fluid through the coiled tubing. Such pressurized drilling fluid drives the hydraulic mud motor which, in turn, rotates the drill bit. The drill bit and hydraulic mud motor are lowered into the borehole as the coiled tubing is spooled off the reel, thereby drilling the borehole deeper into subterranean formations.

A significant advantage of coiled tubing operations over conventional rig operations is that the coiled tubing can be raised and lowered in a borehole at rates up to ten times faster than those possible with conventional rig techniques. This increased speed is primarily attributable to the fact that coiled tubing can be "tripped" in and out of a borehole without screwing or unscrewing individual joints of pipe during the process. In other words, the continuous coiled tubing can be translated in and out of a wellbore without having to stop to add or remove individual joints of pipe.

However, one significant disadvantage of conventional coiled tubing operations is the inability to rotate such tubing within a borehole. Because such conventional coiled tubing cannot be rotated relative to a borehole, during the drilling process all of the energy required to rotate a drill bit must be supplied by pressurized drilling mud which drives a downhole hydraulic mud motor. Further, when conducting downhole operations, it is frequently beneficial to rotate pipe in order to overcome friction between the inner surface of the borehole and the outer surface of the coiled tubing, particularly in highly deviated or horizontal wellbores. Such friction can frequently make it difficult to translate tubing in a borehole and/or to manipulate such pipe in a well. Further, the increased friction between the coiled tubing and the borehole may require more frequent tripping of such coiled tubing.

Attempts have been made to develop coiled tubing units which permit rotation of such tubing within a wellbore. However, such attempts involve complicated and cumbersome equipment which is not practical for most oil and gas operations, particularly where space is at a premium. Thus, it is advantageous to provide a compact, modular unit which allows for translation of pipe continuously into a wellbore while simultaneously permitting rotation of such pipe downhole.

SUMMARY OF THE INVENTION

Like conventional coiled tubing units, the present invention utilizes a continuous length of spooled tubing which can be translated into and out of a wellbore extending into subterranean formations. However, instead of said continuous tubing being coiled around the outer surface of a reel or drum, the continuous flexible tubing of the present invention is spooled within a substantially cylindrical housing or canister.

In the preferred embodiment of present invention, the continuous, flexible tubing spooled within said canister is connected to a pump-in sub at one end, while the other end of said continuous tubing can be translated from said spool into a wellbore. During operation, the distal end of the continuous tubing of the present invention can be guided from the interior chamber formed by said canister and translated into said wellbore. The continuous tubing of the present invention can be translated from said canister and into said wellbore using a device commonly referred to as an "injector head" which is generally well known in the art of conventional coiled tubing operations.

As the continuous tubing of the present invention is translated from said canister and into a wellbore, the canister containing the spooled tubing can be rotated. By rotating the canister, as well as the tubing contained therein, torque is transferred to the unspooled portion of such tubing which extends concentrically downward into said wellbore. In this manner, the portion of such continuous tubing which extends downward into the wellbore can be rotated downhole as desired.

In the preferred embodiment of the present invention, the canister containing the continuous spooled tubing is positioned directly over a well in which such tubing is to be inserted. However, it is to be observed that the location of such canister, and its position relative to such well, can be changed with minor modification to the equipment employed in the present invention without departing from the spirit and scope of the present invention. For example, but not by way of limitation, the canister of the present invention can be located beside a well to be drilled or serviced. Spooled tubing could be translated into said wellbore via use of a "goose-neck" mechanism and injector head, while still permitting downhole rotation of such tubing via rotation of said canister.

In the preferred embodiment of the present invention, an adjustable substructure is provided as a base for the canister. Said adjustable substructure is positioned around the upper opening of a well. In many cases, a well will include a wellhead, "Christmas tree" or other surface structure, such that the actual opening to such well is elevated some distance above the surface of the earth. Said adjustable substructure also includes at least one adjustable lift cylinder which can be raised or lowered, as desired.

At least one rigid support frame is mounted over said adjustable substructure. Said at least one rigid support frame provides a mounting surface for a rotary table and power swivel mechanism. An injector head is mounted below said power swivel and within an enclosure formed by said support frame(s). A substantially cylindrical canister containing continuous spooled tubing is rotatably mounted to said power swivel above the injector head. When the power swivel is engaged, the canister can rotate about a vertical axis passing generally through the upper opening of said well.

A means is provided for communicating fluid from an outside source into the continuous tubing spooled within said canister. In the preferred embodiment, one end of said spooled tubing is connected to a rotatable pump-in sub, which is in turn connected to a hose or other fluid conduit. The conduit or hose connects to a mud pump or other fluid source, while the pump-in sub includes a pump-in sub swivel mechanism to prevent the hose from becoming twisted or tangled upon rotation of said canister. The present invention permits continuous circulation of fluid without need for stopping circulation when making/breaking connections.

The vertical position of the apparatus can be raised and lowered, as desired, via the adjustable substructure of the present invention. Specifically, at least one lift cylinder of said adjustable substructure can be actuated to vertically position the canister, injector head and other associated equipment relative to the upper opening of the wellbore being drilled or serviced by the present invention.

The spooled tubing apparatus of the present invention is exceptionally versatile, in that it can be used in open hole environments, such as for drilling or sidetracking wells. Further, said apparatus can also be used in cased-hole environments, such as for workovers and/or recompletions. Additionally, the apparatus of the present invention also has potential applications which extend far beyond oil and gas wells and the conventional oil and gas industry. For example, by simply orienting the apparatus of the present invention at a slant or angle which is deviated from vertical, said apparatus can be used to drill or otherwise work within slanted or horizontal wells. Moreover, the apparatus of the present invention can also be used to replace current methods of drilling water wells and disposal wells, and can replace conventional trench-less technology for installation of pipelines or conduits.

It should also be noted that the components of the present invention can be easily modified to fit the requirements of a particular application. For example, the apparatus of the present invention can be supported by a crane, or hung within the derrick of a conventional drilling rig using a standard rig traveling block. In many cases, rotation of the canister and, thus, the continuous tubing, can be accomplished using a conventional power swivel and back-up arm, thus eliminating the need for a supporting base or substructure.

BRIEF DESCRIPTION OF THE DRAWINGS

FIG. 4 depicts a partial cut-away side view of the spooled tubing unit of the present invention.

FIG. 5 depicts a detailed view of certain components of the present invention depicted in FIG. 4.

FIG. 6 depicts a detailed view of certain components of the present invention depicted in FIG. 5.

DETAILED DESCRIPTION OF THE PREFERRED EMBODIMENT

Figure 1:
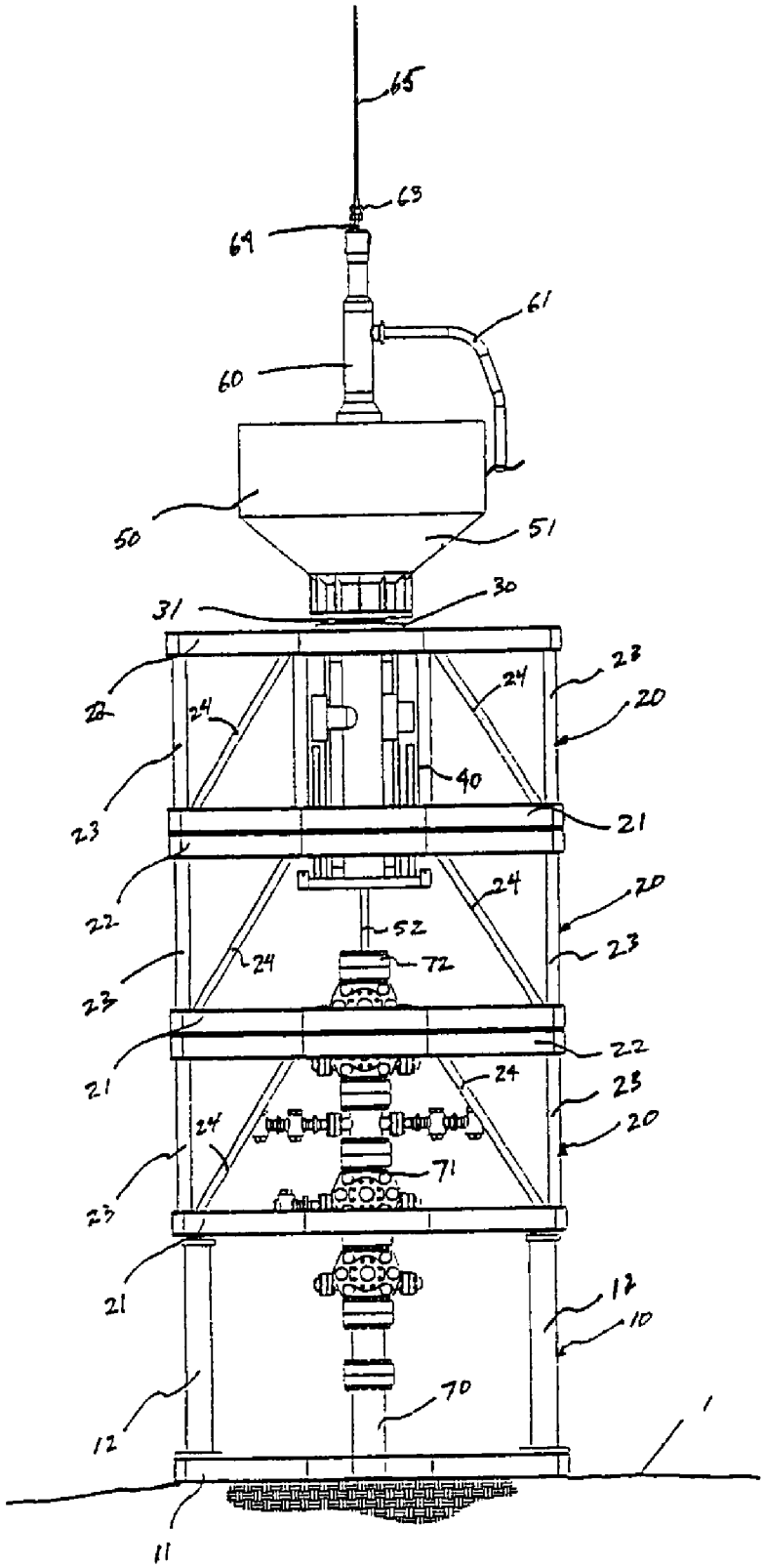
FIG. 1 depicts a side plan view of the spooled tubing unit of the present invention.

Referring to the drawings, FIG. 1 depicts a side plan view of the spooled tubing unit of the present invention. Adjustable substructure 10 is positioned in general proximity to a well, represented in FIG. 1 as well 70, which extends above ground level 1. Surface valves 71, commonly referred to as a "Christmas tree", is connected to the upper end of well 70. In practice, blowout preventers (not shown in the drawings) may be connected to upper flange of Christmas tree 71, or the upper portion of well 70 when such a tree is not installed, in order to prevent uncontrolled flow or release of pressure and/or wellbore fluids from said well into the surrounding environment. In the preferred embodiment, adjustable substructure 10 includes horizontal base members 11 which are generally located around said well 70. A plurality of lift cylinders 12 extend upward from said horizontal base members 11 of adjustable substructure 10. Said lift cylinders 12 having pistons 13 (not shown in FIG. 1) are oriented in such a manner that they are capable of stroking in a substantially vertical direction.

At least one rigid support frame 20 is mounted above adjustable substructure 10. Although a plurality of said rigid support frames are depicted as being stacked on top of one another in FIGS. 1 and 2, it is to be observed that a single such rigid support frame 20 may be used in certain applications. In the preferred embodiment, at least one such rigid support frame 20 is situated directly above the lift cylinders 12 of adjustable substructure 10. Although rigid support frames 20 can be constructed in any number of different configurations, in the preferred embodiment said rigid support frames 20 include lower horizontal members 21, upper horizontal members 22, vertical frame members 23 and a plurality of diagonal structural support members 24.

Rotary table 30 is mounted to upper horizontal members 22 of the uppermost rigid support frame 20 and provides a base for power swivel 31. Power swivel 31 is rotatably disposed within said rotary table 30. Said power swivel 31 is capable of spinning in a clockwise, or counter-clockwise direction, as desired. In the preferred embodiment depicted in FIGS. 1 and 2, said power swivel 31 rotates about an axis which is substantially vertical and which aligned with the upper opening of well 70.

Injector head 40 is mounted beneath said rotary table 30. Said injector head 40 can be one of any number of different conventional configurations known in the art. Although the specific configuration of said injector head 40 is not critical to operation of the spooled tubing unit of the present invention, said injector head 40 must be capable of translating continuous tubing into, or out of, a well, such as via wellhead 70. Further, in the preferred embodiment, said injector head 40 is capable of spinning in response to rotation of power swivel 31. Although not required in every case, in certain applications it may be beneficial to include a conventional tubing straightener which is well known in the art.

Substantially cylindrical canister 50 is rotatably mounted above said rotary table 30 and power swivel 31. In the preferred embodiment of the present invention, canister 50 has a substantially constant diameter at or near the upper portion of said canister, and has tapered lower section 51 near its base where canister 50 is mounted to power swivel 31. Rotation of power swivel 31 in turn results in rotation of canister 50 about a substantially vertical axis passing through well 70.

Figure 2:
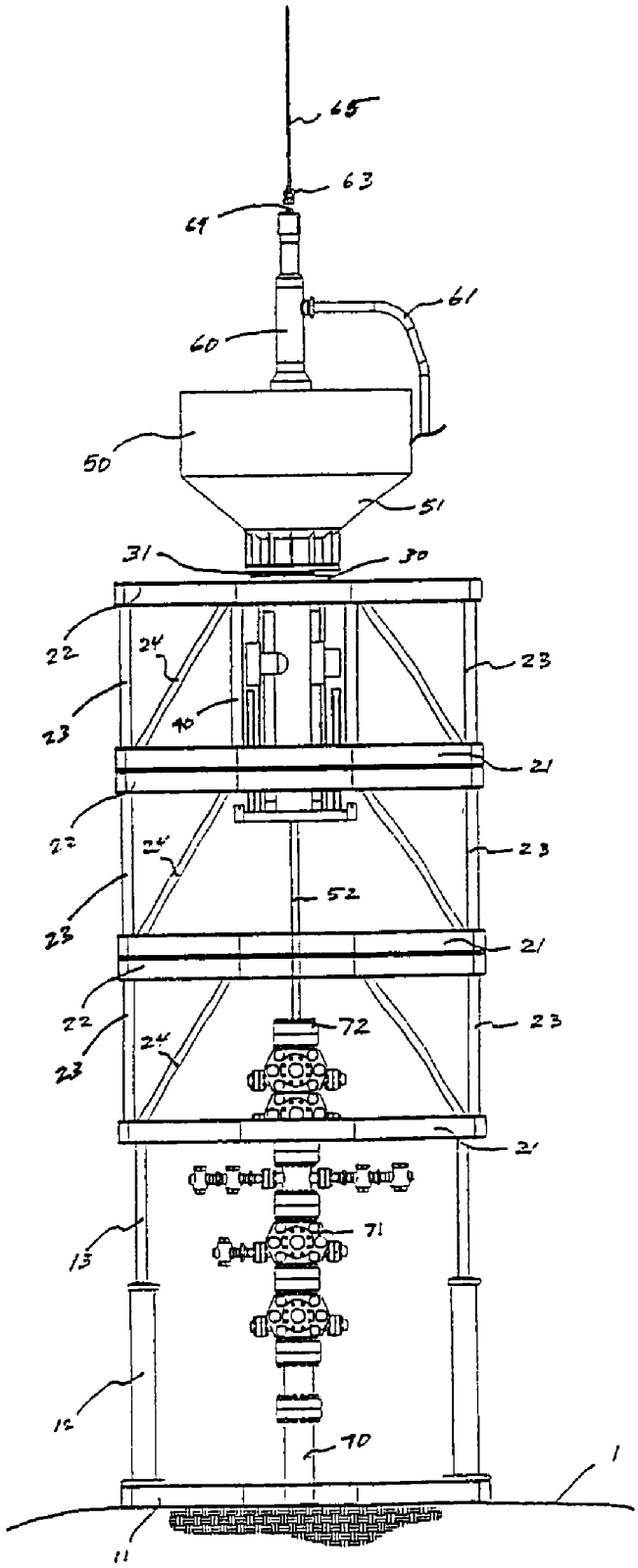
FIG. 2 depicts a side plan view of the spooled tubing unit of the present invention in an extended position.

Pump-in sub 60 is connected generally to the upper surface of canister 50. Said pump-in sub 60 includes a swivel mechanism (which can be one of any number of different existing swivel mechanisms for pump-in subs currently known in the art), and is thus rotatable about a substantially vertical axis passing through the center of canister 50 and well 70. Hose 61 permits fluid to flow from an external location, such as a mud pump or other source, to a length of continuous tubing 52 which is at least partially spooled within canister 50. In FIG. 1 and FIG. 2, such continuous flexible tubing 52 is shown extending out of the lower extent of injector head 40 and into Christmas tree 71. Lift coupling 64, having shackle 63, provides a means to lift the spooled tubing apparatus of the present invention. For example, said spooled tubing apparatus of the present invention can be lifted and placed over a well having Christmas tree 71 using a crane, hoist or other lifting means attached to line 65. Additionally, in certain applications, it may be advantageous to suspend the spooled tubing apparatus of the present invention from line 65 while operations are being conducted. In certain cases, it may be possible to use a suspended power swivel and back-up arm, thereby eliminating the need for adjustable substructure 10 and rigid support frame(s) 20, as well as a rotary table and power swivel mounted thereto.

FIG. 2 depicts a side view of the spooled tubing unit of the present invention in an extended position. It should be noted that FIG. 2 depicts the same basic components and layout as FIG. 1. Namely, adjustable substructure 10 is positioned in general proximity to well 70 having Christmas tree 71. Adjustable substructure 10 forms a base comprised of horizontal base members 11 situated around said well 70 and Christmas tree 71. A plurality of lift cylinders 12 extend vertically upward from said horizontal base members 11. In the preferred embodiment, said rigid support frames 20 are mounted above adjustable substructure 10 on said plurality of lift cylinders 12 of adjustable substructure 10.

As shown in FIG. 2, the vertical position of the spooled tubing apparatus of the present invention can be adjusted relative to wellhead 70 and Christmas tree 71, using lift cylinders 12 of adjustable substructure 10. Specifically, pistons 13 of lift cylinders 12 can be extended a desired length in order to adjust the vertical position of the other components of said spooled tubing apparatus. If additional vertical clearance is needed between the top of Christmas tree 71 and the base of injector head 40, pistons 13 of lift cylinders 12 can be adjusted to provide the desired clearance.

Figure 3:
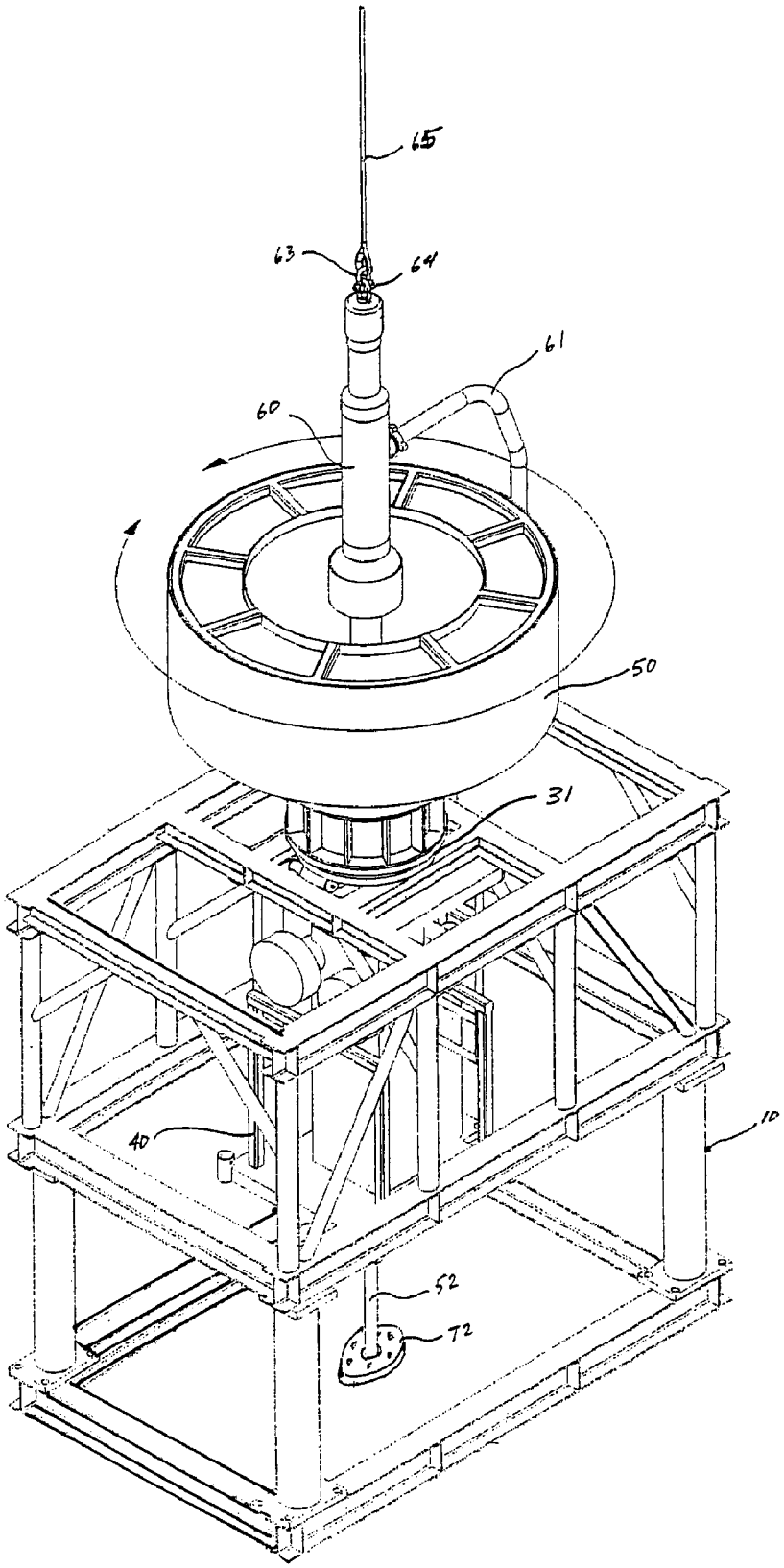
FIG. 3 depicts an overhead perspective view of the spooled tubing unit of the present invention.

FIG. 3 depicts a side perspective view of the spooled tubing apparatus of the present invention. Adjustable substructure 10, which is situated over a well having upper connection flange 72, provides a base for rigid support frame 20. Rigid support frame 20 in turn supports rotary table 30, injector head 40 and canister 50 in general axial alignment over connection flange 72. Continuous flexible tubing 52 extends vertically out of the base of canister 50 and through injector head 40 (not visible in FIG. 4). Said continuous tubing string 52 exits from the base of injector head 40 and extends into upper connection flange 72.

Rotation of power swivel 31 causes canister 50 to rotate about a substantially vertical axis aligned with injector head 40 and the opening and of upper connection flange 72. Hose 61 which supplies fluid from an external source is prevented from twisting or tangling around said canister 50 by pump-in sub swivel mechanism discussed above. The portion of continuous flexible tubing 52 which extends outward from the lower opening of canister 50 passes through injector head 40 into a well represented by upper flange 72. Lift coupling 64 is connected to shackle 63, which is in turn affixed to line 65. Although not shown in FIG. 3, line 65 is attached to a crane or other lifting means which can be used to partially hold up or support the various components of the present invention.

FIG. 4 depicts a partial cut-away side view of the spooled tubing unit 1 of the present invention. Adjustable substructure 10 is positioned over wellhead 70. Lift cylinders 12, which provide a foundation for rigid support frame 20, can be used to selectively adjust the vertical position of spooled tubing apparatus of the present invention relative to wellhead 70. Although the spooled tubing apparatus of the present invention is depicted as being installed directly on said wellhead, it is possible that said apparatus can also be installed directly over a well having a set of surface valves commonly referred to as a Christmas tree. Because wellheads and Christmas trees can have different vertical dimensions, use of lift cylinders 12 having adjustable pistons 13 (as depicted in FIG. 2) to vertically position the present invention provides desired versatility.

Continuous flexible tubing 52 is partially spooled within canister 50. Unlike conventional coiled tubing units wherein such continuous tubing is wrapped or coiled around the outer surface or circumference of a reel or drum, the continuous flexible tubing 52 of the present invention is spooled within the inner chamber of said canister 50.

When insertion of such continuous flexible tubing 52 into a wellbore is desired, the distal end of such continuous flexible tubing is directed into said wellbore using guide 53. Guide 53 directs said continuous tubing 52 from the internal chamber of canister 50 and into injector head 40, where said tubing can be translated into wellhead 70. Specifically, said continuous flexible tubing 52 passes out of the lower end of canister 50, through power swivel 31, rotary table 30, injector head 40 and into wellhead 70. Similarly, when said continuous flexible tubing 52 is retrieved from such a well, guide 53 directs said continuous flexible tubing 52 into the internal chamber of canister 50.

Injector head 40 is used to translate the distal end of continuous flexible tubing 52 into, and out of, said well. When desired, power swivel 31 can be rotated, thereby causing canister 50 and injector head 40 to rotate as well. Because rotation of such equipment causes continuous flexible tubing 52, which spooled within canister 50, to rotate, torque is transferred to the extended portion of said continuous flexible tubing which extends downward into such well. Fluid can be pumped from an outside source through hose 61 and into continuous flexible tubing 52 via internal connection 54. Specifically, mud or other fluid pumped through hose 61 passes through internal connection 54, situated within canister 50, and into continuous flexible tubing 52. Such mud can travel the length of said continuous flexible tubing 52 and exit from the distal end of said continuous flexible tubing 52 within a well.

FIGS. 5 and 6 depict double-lead screw mechanism 54. As continuous flexible tubing 52 is translated in and out of the inner chamber of canister 50 via injector head 40, double lead screw mechanism 54 travels a predetermined distance along the path of said double lead screw. This reciprocating travel of double lead screw 54 causes guide arm 53 to position continuous flexible tubing 52 in an orderly pattern within the inner chamber of canister 50. Hydraulic swivel ports 56 communicate with hydraulic lines 55 which extend to injector head 40 to provide hydraulic control lines to said injector head 40. In this manner, injector head 40 is permitted to rotate without tangling or spinning of necessary hydraulic control lines.

The above disclosed invention has a number of particular features which should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for conducting operations in a well comprising:

a. a support frame;

b. a power swivel connected to said support frame;

c. a substantially cylindrical canister having a top, a bottom, an outer surface and a substantially enclosed internal cavity, wherein said substantially enclosed internal cavity defines an inner surface of said canister;

d. an injector head situated below said canister, wherein said injector head is connected to said power swivel;

e. a bore extending from said substantially enclosed internal cavity through the bottom of said canister;

f. a length of continuous flexible tubing having a first end and a second end, wherein a portion of said tubing is spooled within the internal cavity of said canister, a portion of said tubing is disposed against said inner surface of said canister within said substantially enclosed internal cavity, and the second end of said tubing extends through the bore of said canister and said injector head;

g. a hose; and h. a rotatable pump-in sub having a first port and a second port, wherein said second port is connected to said hose and said first port is connected to the first end of said tubing.

2. The apparatus of claim 1, further comprising means for raising and lowering said canister.

3. The apparatus of claim 2, wherein said means for raising and lowering said canister comprises at least one substantially horizontal hydraulic cylinder attached to said support frame.

* * * * *